United States Patent [19]

Ippoliti

[11] Patent Number: 4,744,110

[45] Date of Patent: May 17, 1988

[54] AUTOMATIC DRAIN SEALER

[76] Inventor: Dino Ippoliti, 422 Main St. Washington #3, Harleysville, Pa. 19438

[21] Appl. No.: 842,124

[22] Filed: Mar. 20, 1986

[51] Int. Cl.[4] ..... A47K 1/14

[52] U.S. Cl. ..... 4/295; 137/433

[58] Field of Search ..... 4/295, 286, 287, 289, 4/191, 661; 137/429, 433; 138/89

[56] References Cited

U.S. PATENT DOCUMENTS 220,773 10/1879 Stuart ..... 4/295

2,524,501 10/1950 Wilhelm ..... 137/433

2,716,422 8/1955 Whitlock, Jr. ..... 137/433

FOREIGN PATENT DOCUMENTS 1429779 3/1976 United Kingdom ..... 4/295

*Primary Examiner*—Henry J. Recla

*Assistant Examiner*—L J. Peters

*Attorney, Agent, or Firm*—Joseph W. Molasky & Assocs.

[57] ABSTRACT

An automatic drain sealer is provided for halting an infestation of insects and gas escapement into a residential or commercial enclosure from a sewer line via a drain of a sink or basin receptacle.

12 Claims, 2 Drawing Sheets

AUTOMATIC DRAIN SEALER

BACKGROUND OF THE INVENTION

The present invention relates in general to the field of sanitation. In particular, this invention relates to the field of preventing an insect infestation or gas escapement into an enclosure from an indigenous source such as a sewer line via a drain in a sink, basin or tub receptacle.

DESCRIPTION OF THE PRIOR ART

Chemical expedients are generally recognized in the prior art as a most convenient and economical manner for terminating insect infestation of any kind into various buildings or enclosures through a sewer connected drain of a liquid retaining receptacle. However, environmental considerations at the present time dictate that wherever possible chemical usage for the above purpose be minimized or even eliminated.

Another existing prior art expedient for eliminating insect infestation through a sewer line requires use of a small mesh grill which is permanently placed over the drain. During a fill cycle of the receptacle a flexible rubber mat is placed upon the grill to prevent liquid from emptying into the sewer line; and when the receptacle is to be emptied the mat is removed and the liquid contents are allowed to drain into the sewer line. A recognized shortcoming of the above described prior art arrangement is that the grill becomes a collector of lint or similar debris so that the drain becomes clogged, and therefore requires constant attention to prevent this condition from occurring.

Another shortcoming of the above described prior art arrangement arises because the grill cannot prevent sewer gases from escaping after the drain cycle is completed. As understood, sewer gases provide unplesant odors that are particularly obnoxious and prior art techniques to prevent insect infestation and gas escapement into any living or work area are not deemed to be either satisfactory or sanitary.

SUMMARY OF THE INVENTION

The present invention relates to an automatic sealer for use with a sink, basin or tub receptacle after a liquid has been expelled therefrom. The sealer is designed to prevent insects and sewer gas from entering into an enclosure which emanates from a sewer line through a receptacle drain opening. The sealer is essentially comprised of two couplable and floatable parts wherein upon decoupling one part is utilized as a stopper to block the drain when a liquid is to be retained within the receptacle; whereas the second decoupled part is allowed to remain floating on a surface of the retained liquid until it is removed from the receptacle by a reformable clamp.

The reformable clamp including first and second ends is provided in accordance with the invention whereat one end is attachable or detachable from said receptacle, and a second end is slidably connected to the second floatable part. The first end of the clamp is detached after the first part of the automatic sealer has been decoupled in order to block the drain for filling the receptacle; and the clamp is reattached when the first part is withdrawn from the drain to expel the liquid out of the receptacle thereby allowing for recoupling to the second part.

At the second end of the deformable clamp there is provided an alignment device for maintaining the first and second recoupled floatable parts of the sealer over the drain. Therefore when the liquid is being expelled from the receptacle the first and second recoupled parts slidably descend in accordance with the surface level of the liquid. After the liquid has been completely expelled, the first and second parts block and seal the drain to prevent insects and gases from entering the enclosure from the sewer line.

It is therefore an object of the invention to provide improved sanitary conditions in a residence or commercial enclosure.

It is another object of the invention to provide a relatively simple and economical means for preventing a drain from being a conduit for insect and gas entry into an enclosure.

It is also an object of the invention to provide an effective seal between a sewer line and a basin or sink drain when not in use.

DESCRIPTION OF THE PREFERRED EMBODIMENTS

Figures 1, 5, 6:
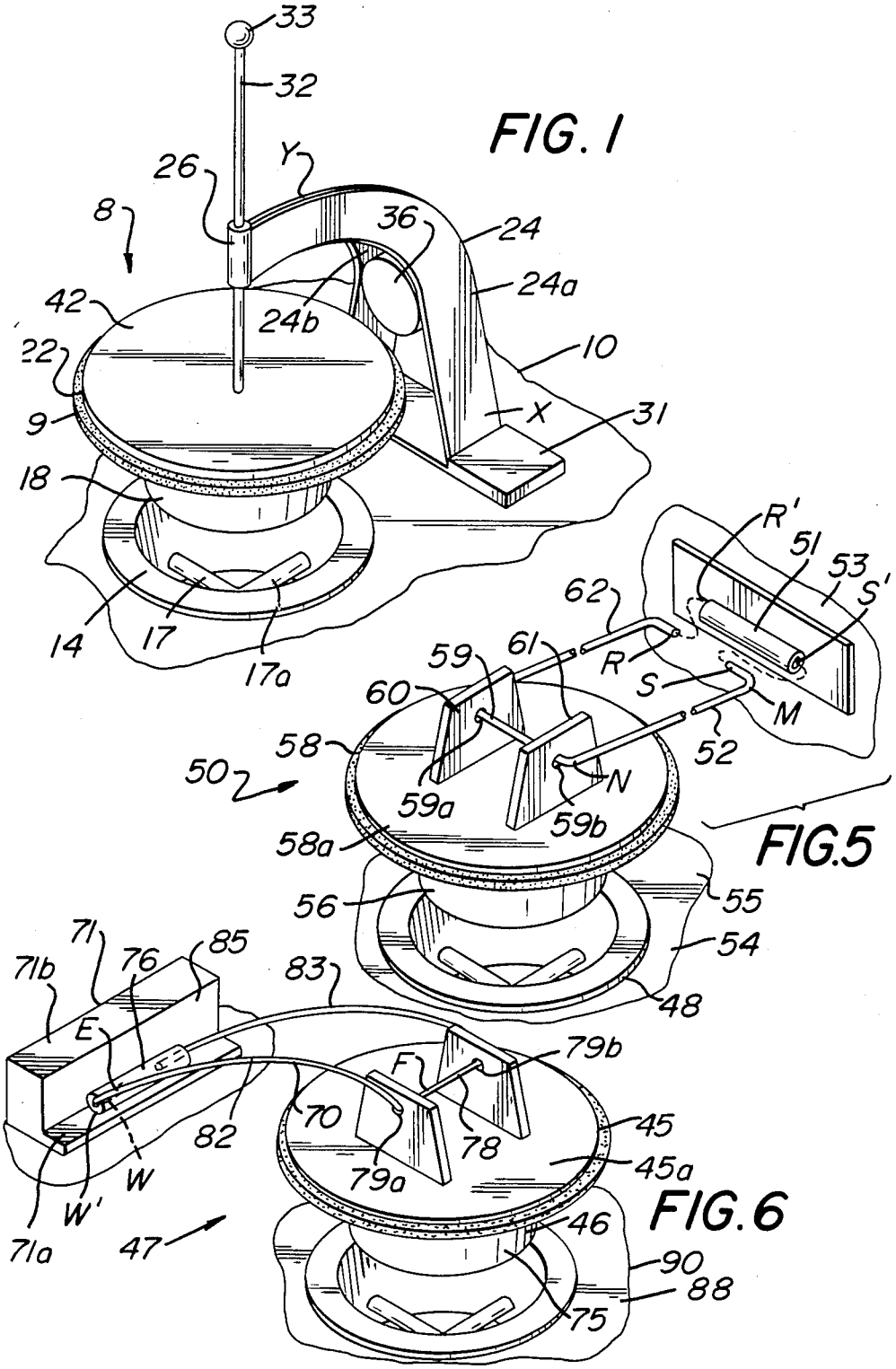
FIG. 1 is an isometric view of an automatic drain sealer embodiment comprising a coupled first part stopper and second part floatation device in alignment above a receptacle drain in accordance with the teachings of this invention.
FIG. 5 is an additional embodiment of this invention.
FIG. 6 is still another embodiment of the invention.
Figure 2:
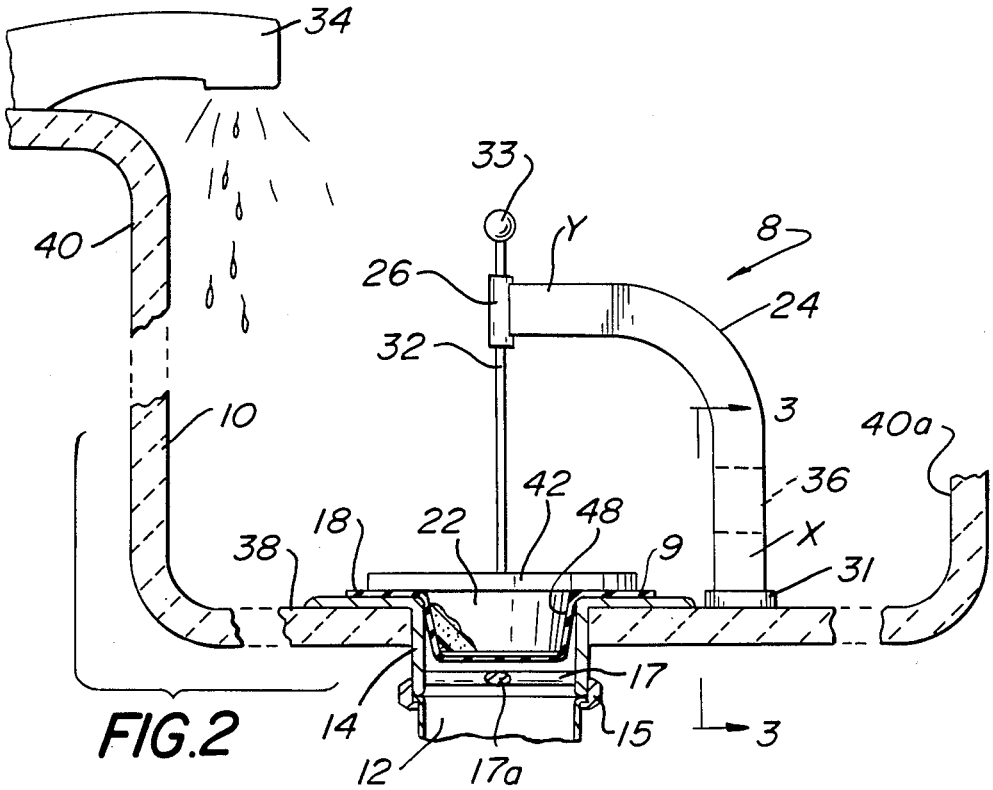
FIG. 2 is an elevational view partially broken away illustrating the sealing action of the coupled stopper and floatation device with the drain.
Figure 3:
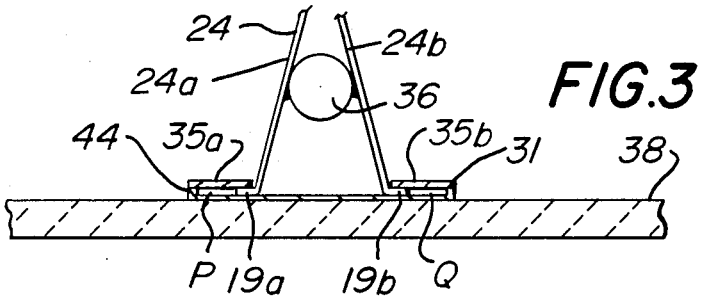
FIG. 3 is a sectional view 3—3 of FIG. 2 showing the reformable clamp attached to the receptacle.
Figure 4:
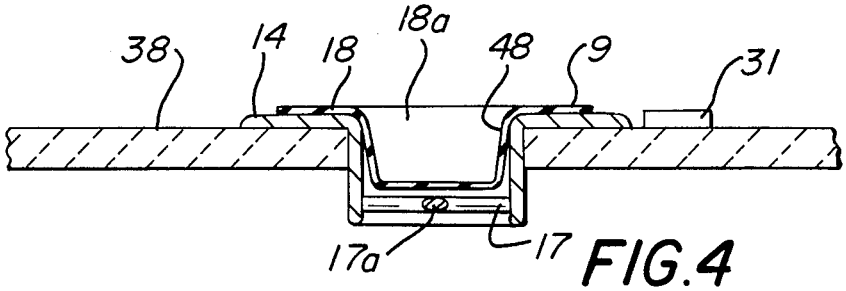
FIG. 4 is a partial view similar to FIG. 2 with certain parts removed to illustrate the stopper being utilized for blocking the receptacle drain.

Referring now to a preferred invention embodiment of FIG. 1 and the cross sectional views thereof in FIGS. 2–4, there is depicted an automatic drain sealer 8 poised in position for sealing a drain 14 located in a sink or basin receptacle 10. Automatic drain sealer 8 is designed to block the drain 14 when the receptacle 10 is empty and not in use in order to prevent an insect infestation or sewer gas escapement from a sewer line 12 (FIG. 2) into the work or living area of an enclosure. In a conventional manner, the drain 14 is located in a bottom section 38 integrally formed with sides 40, **40*a* in a manner to retain liquid within the receptacle 10. A faucet 34 is included with the receptacle 10 to provide a source of liquid for various uses desired by an employee or operator. A coupling 15 is employed to attach the drain 14 to the sewer line 12; and located at the bottom of the drain 14 are cross pieces 17, 17*a* to prevent large members or particles from entering the sewer line 12**.

Automatic drain sealer 8 is essentially comprised of two parts comprising an internally shaped female drain stopper or receiver 18 together with a male member 22 which may be readily coupled to one another (FIGS. 1, 2). The stopper 18 which includes a lip 9 is tapered externally for easy positioning within and against the drain 14 for sealing purposes. Stopper 18 is made of a plastic material whose density is such that it will float on all liquid substances which are utilized by an operator within receptacle 10. Male member 22 which is integrally connected to a plate 42 is also tapered and is adapted to be coupled with a snug fit as well as decoupled from the stopper 18. In order to provide the male member 22 with a floatational characteristic it is also made of a material such as Styrofoam whose density is less than that of the retained liquid. The floatational abilities of the stopper 18 and male member 22 will become clear in later paragraphs.

The poised male member 22 and coupled stopper 18 (FIG. 1) are oriented and aligned with respect to the drain 14 of the receptacle 10 by means of a cantilevered deformable clamp 24 having a proximal end X and a distal end Y. Proximal end X of the cantilever 24 is removably attached to a mounting base 31, which is fixed onto the bottom section 38 of the receptacle 10 as may be further appreciated by referring to FIG. 3. The distal end Y of the clamp 24 is connected to a vertically oriented sleeve 26 which is in alignment with an imaginary centerline through the drain 14. Hence, the sleeve 26 is positioned at a ninety degree angle with respect to the bottom section 38 of the receptacle 10. A rod 32, which is connected at one end to plate 42 integrally joined with the male member 22, and at the other end to a sperical member 33 for easy grasping by an operator, is slidably engaged within the sleeve 26. The slidable rod 32 together with male member 22 achieve vertical motion which corresponds to a height attained by the liquid within receptacle 10.

By continuing to refer to FIGS. 1 and 3 it can be readily appreciated that the clamp 24 attached to mounting base 31 is formed to two legs **24*a* and 24*b*. Positioned between the legs 24*a* and 24*b* is spring-like fulcrum 36 which together provides the deformable clamp 24. The fixed mounting base 31 is formed of three elements consisting of a U-shaped member 44 and two attached horizontal members 35*a* and 35*b*. The mounting base 31 is thereby designed to provide two separated slots P and Q for respectively receiving outwardly projecting feet 19*a* and 19*b* of deformable clamp 24. The clamp 24 may be detached from the receptacle 10 by having the operator squeeze the longitudinal legs 24*a*, 24*b* inwardly against fulcrum 36 so that the projecting feet 19*a*, 19*b* can be removed from slots P, Q; in like fashion, the clamp 24 can be reattached to the receptacle 10 by again squeezing legs 19*a*, 19*b* inwardly so that the feet 19*a*, 19*b*** can be replaced in slots P, Q.

With respect to an operation of the automatic drain sealer 8, let it now be assumed that the receptacle 10 is to be utilized for some purpose such as clothes dying or soaking and in order therefore to retain desired liquid in the receptacle 10 the drain 14 is required to be blocked. Let it further be assumed that a previous status of the automatic sealer 8 is as shown in FIG. 2. Since the female stopper 18 is snugly coupled to the male floatational member 22 it is necessary that they firstly be decoupled from one another. This is readily accomplished by raising the automatic sealer 8 from the drain 14 by grasping the spherical member 33 and pulling upwardly. Once the drain sealer 8 has been raised as shown in FIG. 1 it is then a simple expedient to manually twist off the coupled stopper 18 from the male member 22. Upon the decoupling action above described the stopper 18 is repositioned for blocking purposes within the drain 14 as shown in FIG. 4. Since the drain 14 is now blocked, the faucet 34 (FIG. 2) may be turned on or other liquid source may be made available for filling the receptacle 10. It should be noted here that although the stopper 18 is floatable, it is a practice by an operator to hold it in place until the newly deposited liquid fills the female opening **18*a* (FIGS. 4). The weight of the liquid within female opening 18*a* maintains the stopper 18 in position within drain 14 to prevent its floatation to the liquid surface. As the female opening 18*a* becomes filled and liquid continues to fill receptacle 10, the operator merely removes his hand and the drain blocking operation is completed. During the decoupling procedure for causing the stopper 18 to block drain 14, the floatational male member 22 is simply released and in view of its attachment to slidable rod 32 within sleeve 26 it will simply float on top of the rising liquid surface that is retained within receptacle 10. However, as liquid rises within the receptacle 10 it is usually necessary to maintain the bottom section 38 uncluttered prior to initiating the desired soaking or dying operation. Accordingly, the clamp 24 is detached from the mounting base 31 in the manner previously described by squeezing the longitudinal legs 24*a*, 24*b* against fulcrum 36 until the feet 19*a*, 19*b*** may be removed from slots P, Q.

Let it now be further assumed that the soaking or dying operation is completed within receptacle 10 and it is desired to flush the used liquid down the drain 14 and into the sewer line 12 (FIG. 1). This may be achieved through replacement of the feet **19*a*, 19*b* of the reformable clamp 24 back into the slots P, Q, by again squeezing legs 24*a*, 24*b* inwardly a required amount and then releasing; the clamp 24 will thereby become reclamped to the mounting base 31 in the receptacle 10. As previously described the male member 22 will float upon the surface of the liquid after the clamp 24 is reclamped to the receptacle 10. When the clamp 24 is in place within bracket 31 the stopper 18 (FIG. 4) is removed from the drain 14. This is readily accomplished through the operator by manually pressing against side 48 to cause separation of lip 9 from drain 14. As soon as the lip 9 and drain 14 are separated the stopper 18 may be removed and the retained liquid within the receptacle 10 will empty and be expelled into the sewer line 12. After the stopper 18 is removed from the drain 14 it is again recoupled to the male member 22** wherein both will float on the receding surface of the liquid.

As long as liquid is being expelled and its level is lowering within receptacle 10, the automatic drain sealer 8 is also lowering because the coupled stopper 18 and male member 22 are linked to the slidable rod 32 by way of the plate 22. When the liquid has been finally expelled from fixture 10, the automatic sealer 8 will come to rest within the drain 14 (FIG. 2). As the automatic sealer 8 comes to rest in a final position within drain 14 the lip 9 will lay against drain 14. Therefore, the residential or commercial enclosure is sealed from the sewer line 12. In accordance with the present invention, the sealing of the drain 14 after use prevents an insect infestation or gas escapement from entering the enclosure by way of the sewer line 12.

Referring now to FIG. 5 there is depicted another embodiment of an automatic drain sealer 50 comprised of a stopper 56 and floatational male member 58 for use when the mounting bracket 31 (FIG. 1) is not a satisfactory location along the bottom section 38 of the receptacle 10. In order to obviate this situation a mounting bracket 49 is instead placed upon sidewall 53. A U-shaped wire bail 52, which incorporates a proximal end M and a distal end N, is hinged to the bracket 49 for positioning over the drain 50. The bail 52 is made of a spring steel and includes terminals R, S. The terminals R, S at the proximal end M of the bail 52 are adapted to fit in oversized holes R', S', formed at the extremities of a cylindrical element 51. Cylindrical element 51 is parallelly mounted with respect to bottom section 54 of receptacle 55 and is attached to a top plate 58*a* of male member 58 by means of two separated and vertical protrusions 60, 61. The protrusions 61, 61 include oversized holes 59*a*, 59*b* which are adapted to receive a cross member 59 at distal end N. As can be appreciated, the automatic sealer 50 is hinged to the mounting bracket 49 so that the coupled stopper 56 and male member 58 may be aligned over drain 48 as previously described with respect to FIGS. 1–4. Therefore, in all respects the automatic drain sealer 50 operates in the same manner as the automatic drain sealer 8 of FIGS. 1–4. Thusly, the stopper 56 may be readily decoupled from the male member 58 in order to block drain 48 when it is desired to retain liquid within receptacle 55. Also, the stopper 56 and male member 58 may be recoupled to one another to seal drain 50 when all operations are completed within the receptacle.

As in the operation of the embodiment of FIG. 1, the automatic drain sealer 50 of FIG. 5 may be readily removed from the mounting bracket 49 in an event that the hinged male member 58 interferes with the operational activity that is occurring within the receptacle 54. In order to remove the male member 58 from the mounting bracket 49, the legs 62, 63 of bail 52 are carefully spread apart by the operator so that terminals R, S are removed from openings R', S' of the cylindrical element 51. Since the bail 52 is made of a spring steel no permanent set is retained therein so that it returns to its normal configuration, and therefore the bail 52 acts as a deformable clamp. On the other hand, when liquid is to be expelled through drain 48 the bail 52 is replaced onto the mounting bracket 49 by again spreading the legs 62, 63 so that terminals R, S can be reinserted into the oversized holes R', S' of cylindrical element 51; and the male member 58 is recoupled to the stopper 56 after the latter has been removed to allow expelling liquid into the drain 48. Accordingly, as the liquid recedes within receptacle 55, the automatic sealer 50 enters and seals drain 48 after all liquid has been removed from the receptacle 55. As understood, therefore, no insect infestation or gas escapement is allowed to enter an enclosure from the connecting drain 48 attached to a sewer line (not shown).

A third embodiment of the invention shown in FIG. 6 illustrates an automatic drain sealer 47 which utilizes a double stepped bracket 71 for mounting on a bottom section 88 of a receptacle 90. Steps 71*a*, 71*b* separated by a vertical wall 85 are formed in the bracket 71 wherein step 71*a* serves as a resting place for cylinder 67. A male member 45 by way of its connecting plate 45*a* is hinged to the bracket 71 by way of a U-shaped cantilevered deformable clamp 70. The clamp 70 having proximal and distal ends E, F, respectively, incorporates a pair of longitudinal legs 82, 83. At the proximal end E the legs 82, 83 end in terminals W, X which are adapted to fit in oversized holes W', X' formed at the extremities of cylinder 76. The clamp 70 at the distal end F includes a cross member 78 which is adapted to fit within oversized holes 79*a*, 79*b* located within vertical protrusion 80, 81. The protrusions 80, 81 are attached to a plate 45*a*, which is integrally joined to floatable male member 46. The deformable clamp 70 is designed to operate with a hinging action for automatic drain sealer 47 as the water level increases or decreases within receptacle 90.

The embodiments of FIG. 6 are particularly adaptable to accommodate a situation wherein the water in the receptacle 90 fills to a high level. Since the bracket 71 is located on the bottom section 88 it is possible that the hinging action of the deformable clamp 70 could tip over backwardly. Hence, when the liquid recedes under these circumstances the automatic sealing provided by the coupled stopper 46 and male member 45 would not occur. The vertical wall 85 provided by bracket 71 prevents the clamp 70 from tipping over in order to eliminate the alluded to possibility above mentioned.

This invention has been described by reference to precise embodiments, but it will be appreciated by those skilled in the art that this invention is subject to various modifications and to the extent that those modifications would be obvious to one of ordinary skill they are considered as being within the scope of the appended claims.

What is claimed is:

1. An apparatus for preventing insect and gas infestation into an enclosure from a drain located within a receptacle for retaining a liquid comprising:

(a) a sewer line for connection to said drain and for expelling said liquid therein;

(b) means for sealing said drain comprising first and second circular coupled parts, said first part being decoupled from said second part for blocking said drain when liquid is to be retained within said receptacle, and said second part being bouyant so as to float on a liquid surface;

(c) means attachable to or detachable from said receptacle to provide a reformable clamp means having distal and proximal ends wherein said reformable clamp means is detached at said proximal end from said receptacle after said first part has been decoupled from said second part and utilized to block said drain opening, and said reformable clamp means being reattached at said proximal end to said receptacle when said first part has been recoupled to said second part and when liquid is being expelled from said receptacle;

(d) means provided by said reformable clamp at said distal end for slidably aligning said first and second recoupled parts over said drain, wherein when said liquid is completely expelled from said receptacle said respective first and second recoupled parts will automatically block and seal said drain to prevent insects and gases from entering said enclosure from said sewer line.

2. The apparatus in accordance with claim 1 wherein said first part comprises an externally shaped male stopper which resembles a truncated, conical member for blocking said drain when liquid is to be retained in said receptacle.

3. The apparatus in accordance with claim 2 wherein said male stopper further includes an internally shaped female receiver.

4. The apparatus in accordance with claim 2 wherein said floatable second part comprises a male shaped member that may be coupled to or decoupled from said female shaped receiver.

5. The apparatus in accordance with claim 1 wherein said reformable clamp comprises a cantilever having first and second equal length longitudinal legs and each having said proximal and distal ends, and said distal ends being integrally joined with one another, and further said proximal ends being freely movable in an inward and outward direction for attachment to or detachment from said receptacle.

6. The apparatus in accordance with claim 5 wherein said longitudinal legs further include at their respective proximal ends first and second outwardly projecting feet.

7. The apparatus in accordance with claim 6 and further including a member attached to a bottom surface of said receptacle which provide first and second separated slots, said first slot adapted to receive said first outwardly projecting foot and said second slot adapted to receive said second projecting foot.

8. The apparatus in accordance with claim 7 and further including a spring-like fulcrum located between and centrally disposed between said first and second longitudinal legs to provide said reformable clamp, whereby said clamp may be attached to and detached from said receptacle by inserting and removing said projecting feet from said respective separated slots.

9. The apparatus in accordance with claim 5 wherein said distal end of said integrally joined longitudinal legs further comprising a vertically positioned sleeve member.

10. The apparatus in accordance with claim 9 wherein said vertically positioned sleeve member being adapted to receive a slidably engaged rod member having first and second terminal points wherein said first terminable member being connected to said floatable second part.

11. The apparatus in accordance with claim 10 and further including a spherical member which is attached to said second terminal member of said slidable rod member for easy grasping by an operator.

12. An apparatus for preventing an infectation of insects and gases into an enclosure from a drain located within a receptacle for retaining a liquid comprising:

(a) a sewer line for connection to said drain for allowing a discharge of said liquid therein;

(b) a first float means which is cup-shaped to hold a portion of said liquid for creating a weight when initially filling said receptacle;

(c) a flange surrounding said first float means which fits around said drain;

(d) a second float means which is coupled with and decoupled from said first float means;

(e) means attached to said second float means and also removably attached to said receptacle for allowing vertical motion of said second float means in alignment with and above said drain opening, said vertical motion being achieved in accordance with a level attained by said liquid within said receptacle, and said first float means being decoupled from said second float means and inserted into said drain when liquid is to be retained within said receptacle, and said first float means being recoupled with said second float means when liquid is being expelled from said receptacle;

(f) wherein as the surface level of the draining water descends and liquid is completely expelled from said receptacle, said coupled first and second float means recloses and seals said drain from said sewer line to prevent any insect infestation or gases from entering into said enclosure.

* * * * *